US011104540B2

(12) United States Patent
Tsai

(10) Patent No.: US 11,104,540 B2
(45) Date of Patent: Aug. 31, 2021

(54) FIBER PRODUCT FOLDING AND STACKING SYSTEM

(71) Applicant: CHAN LI MACHINERY CO., LTD., Taoyuan (TW)

(72) Inventor: Tung-I Tsai, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 86 days.

(21) Appl. No.: 16/194,561

(22) Filed: Nov. 19, 2018

(65) Prior Publication Data

US 2019/0359445 A1 Nov. 28, 2019

(30) Foreign Application Priority Data

May 24, 2018 (TW) ..... 107117678

(51) Int. Cl.
*B65H 45/16* (2006.01)
*B65H 31/32* (2006.01)

(52) U.S. Cl.
CPC ..... *B65H 45/16* (2013.01); *B65H 31/32* (2013.01); *B65H 2406/35* (2013.01); *B65H 2701/174* (2013.01)

(58) Field of Classification Search
CPC .... B65H 45/16; B65H 31/32; B65H 2406/35; B65H 2701/174; B65H 2406/3612; B65H 2701/1924; B65H 29/243; B65H 406/361; B65H 45/24
USPC ..... 493/405
See application file for complete search history.

(56) References Cited

U.S. PATENT DOCUMENTS 2,254,217 A * 9/1941 Grupe ..... B31B 50/00 493/333
3,957,570 A * 5/1976 Helm ..... B31B 70/00 156/519
5,021,111 A * 6/1991 Swenson ..... A61F 13/15601 156/264
6,059,710 A * 5/2000 Rajala ..... A61F 13/15764 493/346

(Continued)

FOREIGN PATENT DOCUMENTS

CN 102009869 A 4/2011
CN 202337392 U 7/2012

(Continued)

*Primary Examiner* — Thanh K Truong
*Assistant Examiner* — Katie L Gerth
(74) *Attorney, Agent, or Firm* — Rosenberg, Klein & Lee

(57) ABSTRACT

The invention provides a fiber product folding and stacking system comprising at least one folding wheel, a plurality of suction channels, a plurality of valves and a plurality of passages. The folding wheel includes a plurality of protruding wheels and a plurality of recessing wheels. The protruding wheels and the recessing wheels are adjacent to each other, and suction channels are arranged within the protruding wheels. The passages are disposed in the folding wheel and are fluidly connected to the suction channel. The valves are disposed within the recessing wheels of the folding wheel, and include a connecting opening, a valve channel and a valve opening. When the folding wheel rotates, portion of the suction channels will be fluidly connected to the valve channel through the passage and the valve opening to generate a negative pressure thereon for absorbing the fiber product.

9 Claims, 8 Drawing Sheets

(56) References Cited

U.S. PATENT DOCUMENTS 6,074,333 A * 6/2000 Rajala ..... A61F 13/15756 493/346
6,634,269 B2 * 10/2003 Eckstein ..... B26D 7/018 83/100
6,971,981 B2 * 12/2005 Dobslaw ..... A61F 13/15626 493/338
7,082,645 B2 * 8/2006 Hlaban ..... A61F 13/15626 19/205
7,121,994 B2 * 10/2006 Haasl ..... B65H 45/24 493/442
7,758,485 B2 * 7/2010 Elmer, II ..... G01G 19/34 493/231
8,100,253 B2 * 1/2012 Walsh ..... A61F 13/15764 198/476.1
2002/0140151 A1 * 10/2002 Couturier ..... B65H 23/245 270/58.07
2008/0200324 A1 * 8/2008 Morelli ..... B65H 45/28 493/430
2009/0137375 A1 * 5/2009 Tsai ..... B65H 45/24 493/442
2010/0261594 A1 * 10/2010 Michler ..... B65H 45/24 493/415
2011/0071010 A1 * 3/2011 Lien ..... B65H 45/24 493/450
2014/0203498 A1 * 7/2014 Law ..... B65H 29/32 271/145

FOREIGN PATENT DOCUMENTS

CN 108016930 A * 5/2018 ..... B65H 45/24
CN 108016930 A 5/2018
JP 2011213467 A 10/2011
WO 2011072542 A1 6/2011
WO 2017168232 A1 10/2017

* cited by examiner

FIBER PRODUCT FOLDING AND STACKING SYSTEM

REFERENCE TO RELATED APPLICATIONS

This non-provisional application claims priority claim under 35 U.S.C. § 119(a) on Taiwan Patent Application No. 107117678 filed May 24, 2018, the entire contents of which are incorporated herein by reference.

FIELD OF THE INVENTION

The present invention relates to a fiber product folding and stacking system for adsorbing and folding the fiber product.

BACKGROUND

FIG. 1 is a cross section view of a fiber product folding and stacking system according to the prior art. FIG. 2 is a cross section view of a protruding wheel of the fiber product folding and stacking system according to the prior art. The fiber product folding and stacking system 10 comprises a folding wheel 11 and a passage 13, wherein the folding wheel 11 has a plurality of protruding wheels 111. The passage 13 is disposed along the axial direction within the folding wheel 11.

As shown in FIG. 2, pluralities of suction channels 1111 are disposed within the protruding wheel 111, and are connected with the passage 13. The air is pumped from the passage 13 and the suction channel 1111 for forming a negative pressure on an opening of the suction channel 1111 located on the surface of the protruding wheel 111. Thus, the fiber produce is adsorbed on the surface of the protruding wheel 111, and then can be folded by the fiber product folding and stacking system 10.

Nevertheless, the lengths of the folding wheel 11 and the passage 13 are long, so that the negative pressure formed on each suction channel 1111 of each protruding wheel 111 may be different, causing the suction force on each suction channel 1111 of the folding wheel 11 being different. Further, when the folding wheel 11 is rotating at a high speed, it may cause the adsorbed fiber product to fall off form the folding wheel 11.

SUMMARY

An object of the present invention is to provide a fiber product folding and stacking system comprising at least one folding wheel and a plurality of valves. Each valve is disposed on the folding wheel, and an air extractor is able to exhausts the air in the suction channel within the folding wheel via the valve. The valves are respectively disposed in the vicinity of each suction channel to quickly form a negative pressure on each suction channel. Thus, when the folding wheel performs folding operation, the suction channel on the folding wheel can quickly adsorb or release the fiber products, thereby improving the folding efficiency of the folding wheel.

Another object of the present invention is to provide a fiber product folding and stacking system comprising at least one folding wheel and a plurality of valves. An air extractor is able to exhausts the air in the suction channel within the folding wheel via the valves to form a stable and uniform negative pressure on the surface of the folding wheel. Thereby, the fiber product can be stably adsorbed on the surface of the folding wheel, and the deformation of the fiber product during the folding process can be avoided to improve the yield of the product.

According to an embodiment of the present invention, a fiber product folding and stacking system comprising: at least one folding wheel comprising a plurality of protruding wheels and a plurality of recessing wheel, wherein the protruding wheel is adjacent to the recessing wheel; a plurality of suction channels disposed within the protruding wheel and fluidly connected to an out surface of the protruding wheel; at least one valve disposed in the recessing wheel of the folding wheel, wherein the valve comprises a connecting opening, a valve channel and a valve opening, and the connecting opening is fluidly connected to the valve opening via the valve channel; and a plurality of passages disposed within the folding wheel, and fluidly connected to the suction channel, wherein portion of the passages of the folding wheel is fluidly connected the valve opening.

BRIEF DESCRIPTION OF THE DRAWINGS

The structure as well as preferred modes of use, further objects, and advantages of this invention will be best understood by referring to the following detailed description of some illustrative embodiments in conjunction with the accompanying drawings, in which.

DETAILED DESCRIPTION OF THE PREFERRED EMBODIMENTS

Figure 1:
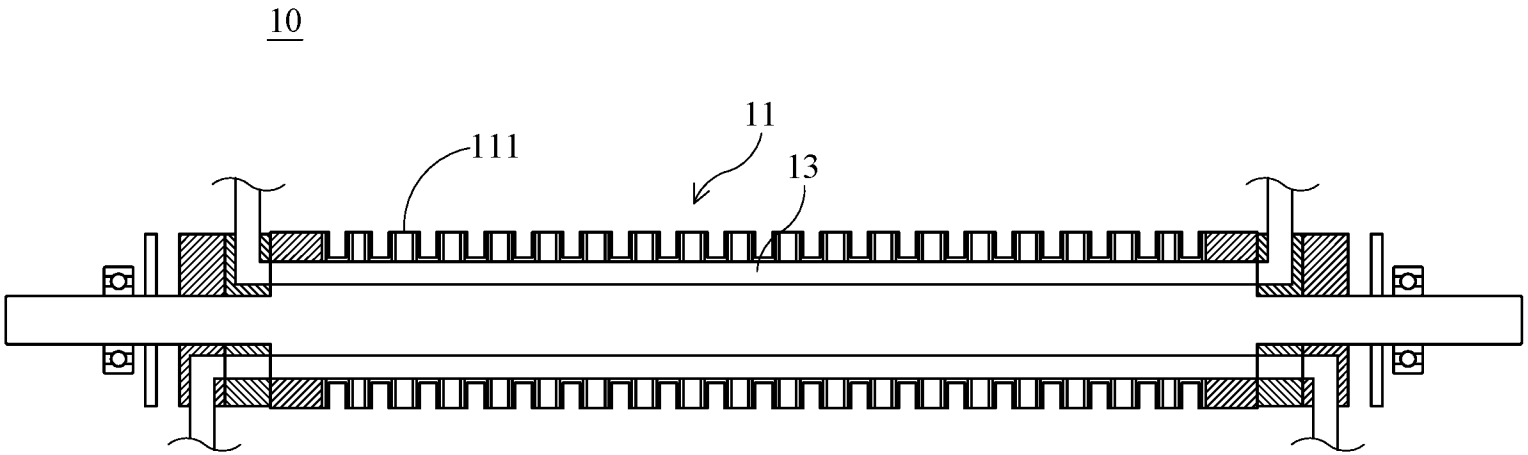
FIG. 1 (PRIOR ART)
FIG. 1 is a cross section view of a fiber product folding and stacking system according to the prior art.
Figure 2:
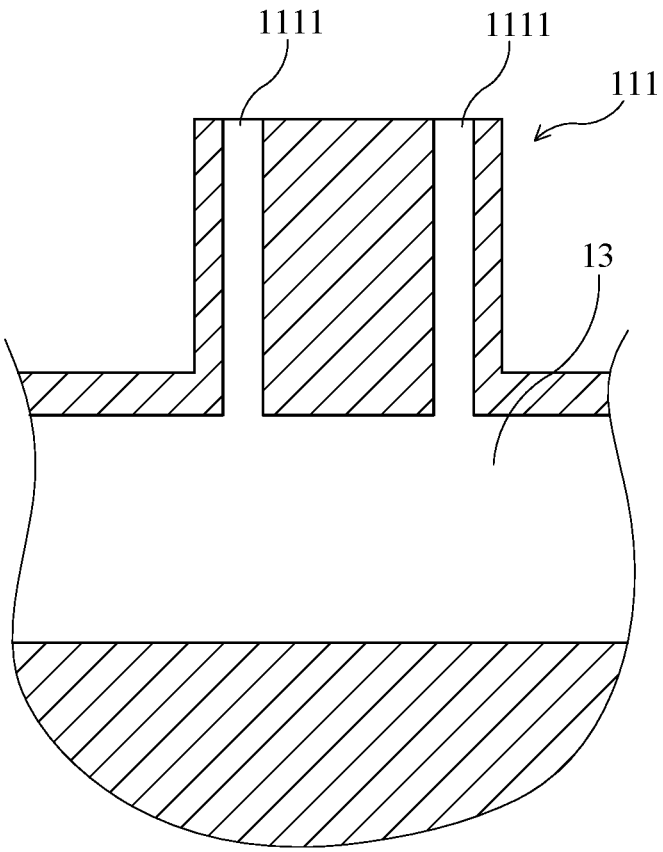
FIG. 2 (PRIOR ART)
FIG. 2 is a cross section view of a protruding wheel of the fiber product folding and stacking system according to the prior art.
Figure 3:
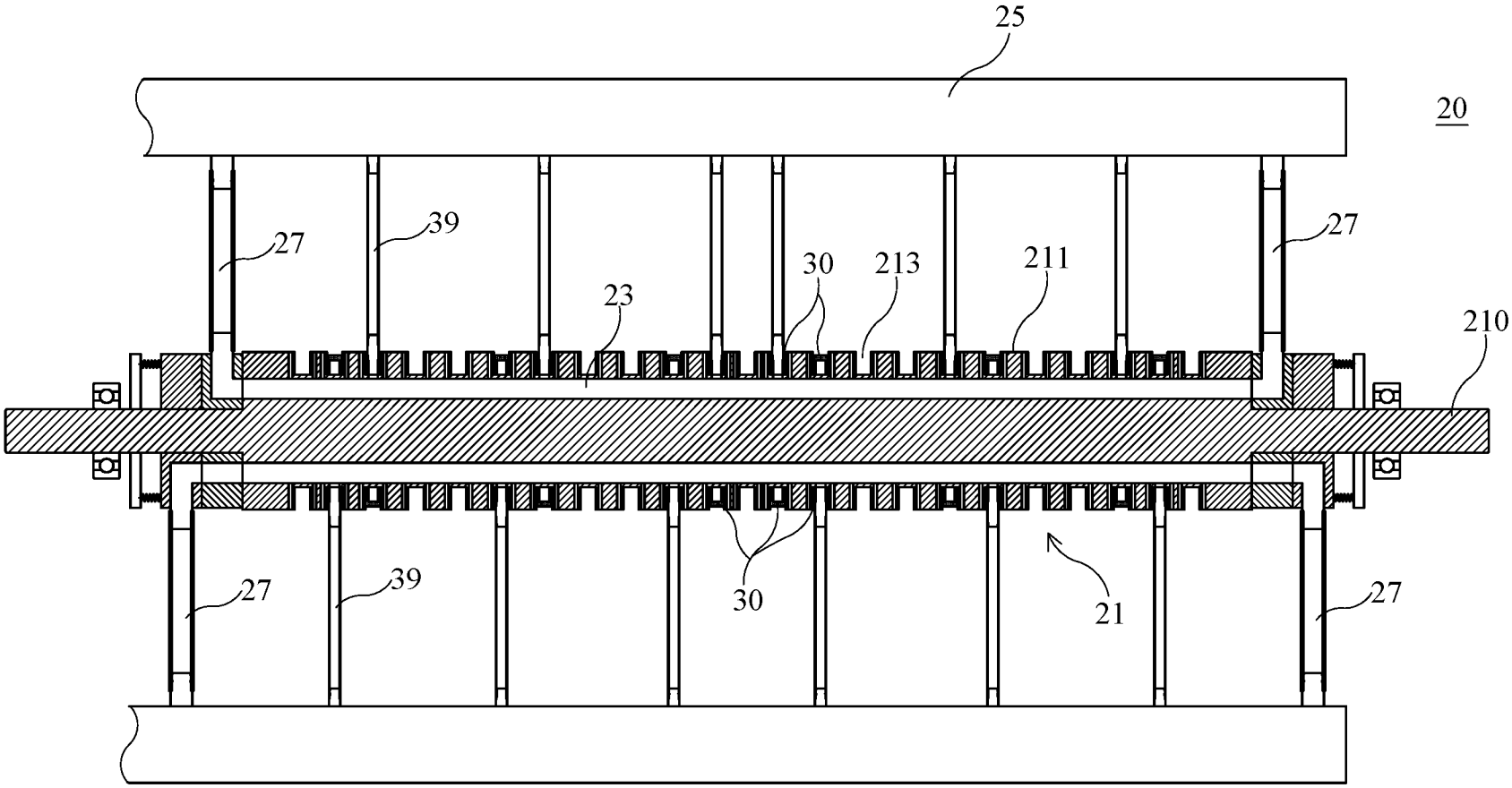
FIG. 3 is a schematic cross-sectional view of a fiber product folding and stacking system according to an embodiment of the invention.
Figure 4:
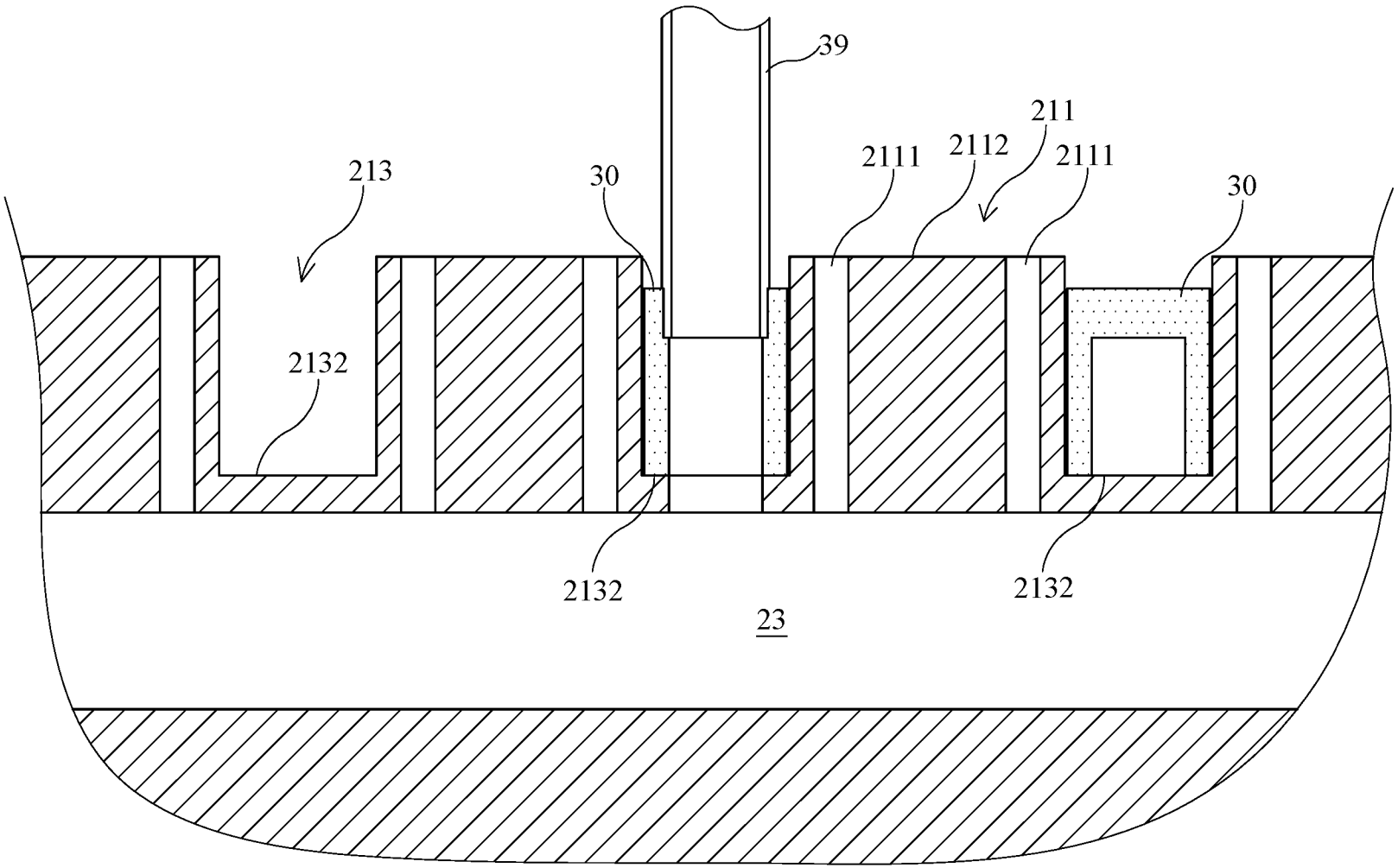
FIG. 4 is a schematic cross-sectional view of a protruding wheel according to an embodiment of the invention.
Figure 5:
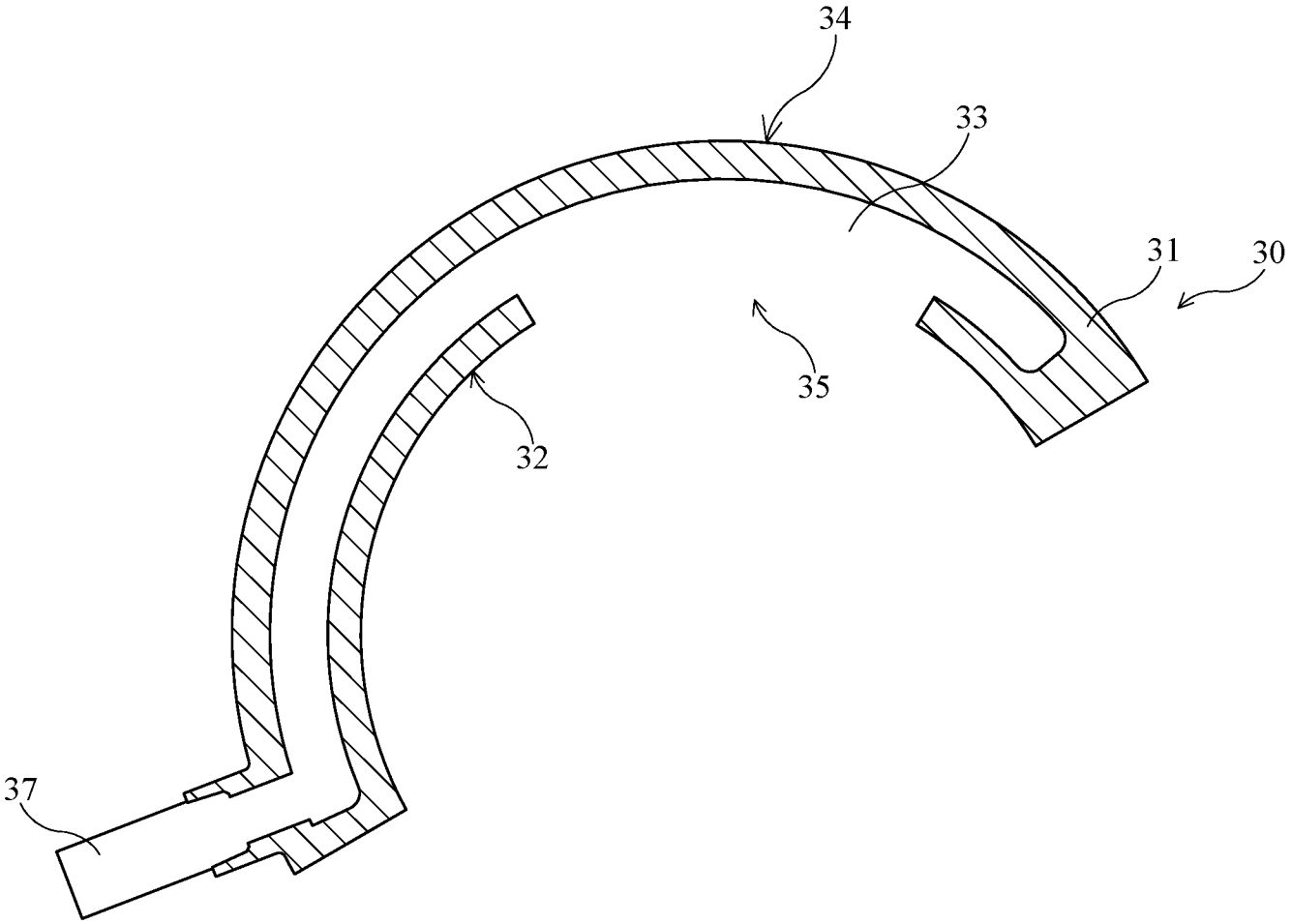
FIG. 5 is a schematic cross-sectional view of a valve according to an embodiment of the invention.

FIG. 3, FIG. 4 and FIG. 5 are respectively schematic cross-sectional views of a fiber product folding and stacking system, a protruding wheel and a valve according to an embodiment of the invention. The fiber product folding and stacking system 20 comprises at least one folding wheel 21, a plurality of passages 23 and at least one valve 30. The folding wheel 21 comprises a plurality of protruding wheels 211 and recessing wheels 213. The protruding wheel 211 and the recessing wheel 213 are cylinder, and adjacent and staggered.

Pluralities of passages 23 are disposed within the folding wheel 21. For example, the passages 23 are disposed along the axial direction of the folding wheel 21. Each protruding wheels 211 has at least one suction channel 2111. One end of the suction channel 2111 is connected to passage 23, and the other end of the suction channel 2111 is connected to the out surface 2112 of the protruding wheel 211. For example, the suction channel 2111 is disposed along the radial direction of the folding wheel 21, and is perpendicular to the passage 23.

In one embodiment of the invention, the passage 23 may connect to an air extractor 25 via at least one connecting pipe 27. The air extractor 25 exhausts the air in the suction channel 2111 via the connecting pipe 27 and the passage 23 to form a negative pressure on the suction channel 2111 connected to the out surface 2112 of the protruding wheel 211.

In another embodiment of the invention, the folding wheel 21 may comprise a shaft 210 and a plurality of protruding wheels 211. The shaft 210 is cylinder or a rod, and each protruding wheel 211 is disposed on the shaft 210 along the axial direction thereof, and the recessing wheel 213 is formed between two adjacent protruding wheels 211. Further, the passage 23 is located within the shaft 210 or the folding wheel 21.

Figure 6:
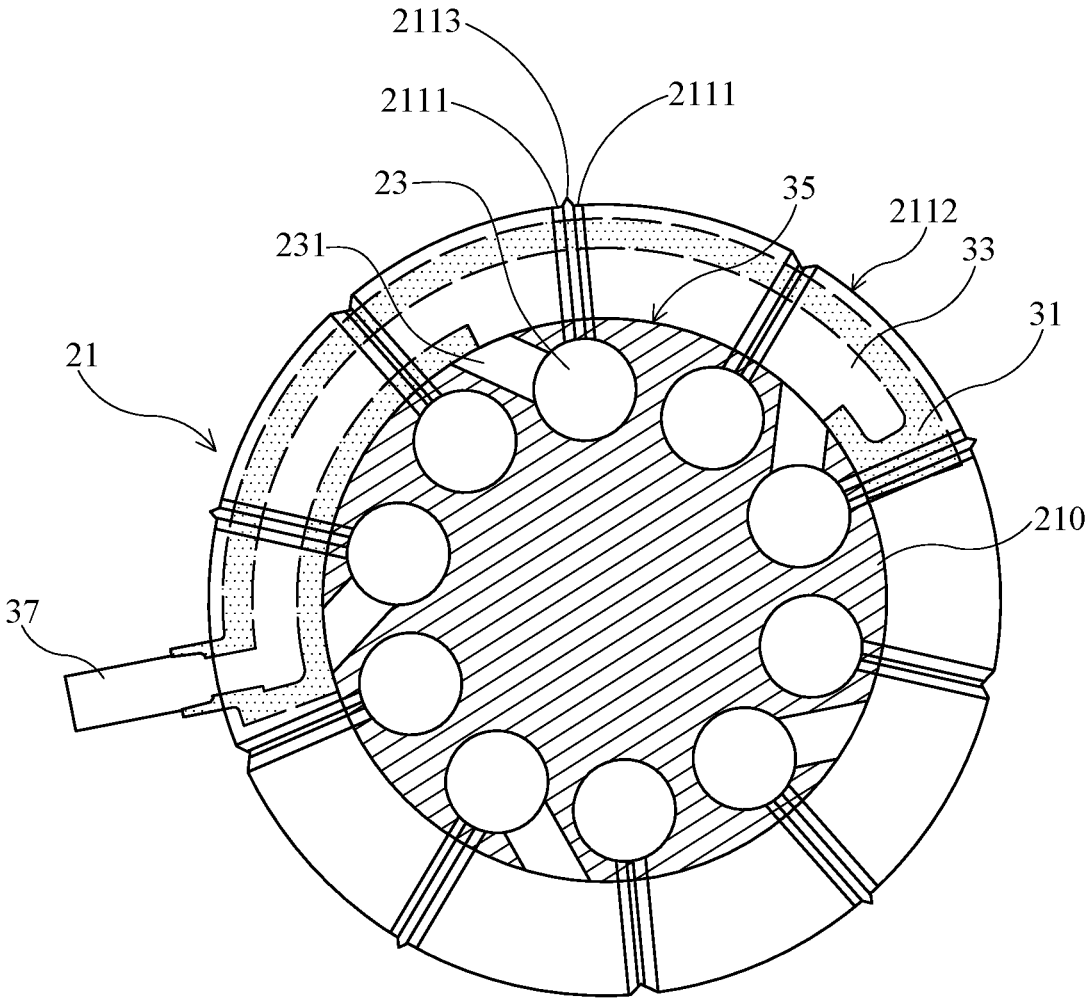
FIG. 6 is a perspective view of a protruding wheel of a fiber product folding and stacking system according to an embodiment of present invention.

The valve 30 is disposed within part of recessing wheels 213. For example, the shape of the valve 30 may be a semi-ring or a circular arc, and is disposed on partially or wholly surface of the recessing wheel 213, as shown in FIG. 6. More specifically, the valve 30 may comprise a main body 31, a valve channel 33, a valve opening 35 and a connecting opening 37, wherein the valve channel 33 is located within the main body 31, and the connecting opening 37 is connected to the valve opening 35 via the valve channel 33.

The valve 30 is adjacent to the protruding wheel 211, and the valve opening 35 of the valve 30 is fluidly connected to part of passages 23 within the folding wheel 21. In one embodiment of the invention, part or all of passages 23 are fluidly connected to the out surface 2132 of the recessing wheel 213, and connected to the valve opening 35 of the valve 30. For example, part or all of passages 23 are connected to the out surface 2132 of the recessing wheel 213 via at least one connecting channel 231.

Specifically, the valve 30 includes an inner surface 32 and an outer surface 34. The valve 30 is disposed within the recessing wheel 213, and the inner surface 32 of the valve 30 is attached to the portion of the outer surface 2132 of the recessing wheel 213, such that the valve opening 35 fluidly connects to the connecting channel 231 located on the outer surface 213 of the recessing wheel 213. Therefore, when the valve 30 is disposed within the recessing wheel 213, the valve opening 35 will fluidly connect with a portion of the passages 23, for example, the valve opening 35 may connect with part of the passages 23 via the connecting channel 231.

The connecting opening 37 is connected to the air extractor 25 via a connecting pipe 39. The air extractor 25 can be activated to evacuate the air in the valve channel 33 of the valve 30 via the connecting pipe 39. During the rotation of the folding wheel 21, portion of the suction channel 2111 of the protruding wheel 211 is connected to the valve opening 35 via the passage 23 and the connecting channel 231, and a negative pressure is formed on the portion of the suction channels 2111 of the protruding wheel 213 to adsorb the fiber product, for example, the fiber product may be toilet paper, facial tissue, non-woven fabric, or the like.

In practical application, a motor (not shown) is connected to the folding wheel 21 for driving rotation of the folding wheel 21. When the folding wheel 21 is rotating, the valve 30 does not rotate with the folding wheel 21. Therefore, the folding wheel 21 rotates relative to the valve 30, and at least one of passages 23 in the folding wheel 21 can sequentially connect with the valve opening 35 via the connecting channel 231, so that the suction channels 2111 on the protruding wheel 211 will form the negative pressure sequentially.

In one embodiment of the present invention, the fiber product folding system and stacking system 20 may include a plurality of valves 30 that are respectively disposed in portion of recessing wheels 213 of the folding wheel 21, wherein the connecting openings 37 of each valve 30 are respectively fluidly connected to the air extractor 25. Through the arrangement of the plurality of valves 30, it is advantageous to form a uniform pressure in the passages 23 of the folding wheel 21, and generate a similar or the same negative pressure on each of suction channels 2111 of the folding wheel 21, whereby the fiber product 22 can be stably fixed or absorbed on the surface of the folding wheel 21. Thus, when the folding wheel 21 is rotating at a high speed, the fiber product 22 will not fall off from the folding wheel 21.

In addition, through the arrangement of the plurality of valve 30, portion of the suction channels 2111 of each protruding wheel 211 can from the negative pressure synchronously. For example, the suction channels 2111 on the same angle of each protruding wheel 211 may simultaneously generate the negative pressure. In other words, through the folding system 20 of the present invention, the suction channels 2111 of each protruding wheel 211 at the same angle can simultaneously generate a negative pressure, so that the suction channels 2111 of the folding wheel 21 at the same angle can simultaneously adsorb or release the fiber products at the same time.

In the present invention, the fiber product folding and stacking system 20 comprises a plurality of valves 30 respectively disposed in the vicinity of each suction channel 2111. Therefore, the air extractor 25 can perform the suction of air in the each suction channel 2111 through the valves 30 that are close to the suction channel 2111, so that each suction channels 2111 quickly form a stable negative pressure.

FIG. 6 is a perspective view of a protruding wheel of a fiber product folding and stacking system according to an embodiment of present invention. A plurality of protrusions 2113 are disposed on the outer surface 2112 of the protruding wheel 211 of the folding wheel 21, and the suction channels 2111 are adjacent to the protrusions 2113. For example, suction channels 2111 are disposed on both sides of each protrusion 2113. When the folding wheel 21 is rotating to a predefined position or angle, the suction channels 2111 that is adjacent to portion of protrusions 2113 will communicate with the connecting opening 37 via the valve opening 35 and the valve channel 33 of the valve 30. Thus, the suction channels 2111 on both sides of portion of the protrusions 2113 generate the negative pressure to absorb the fiber product, and then perform a folding operation of the fiber product.

Figure 7:
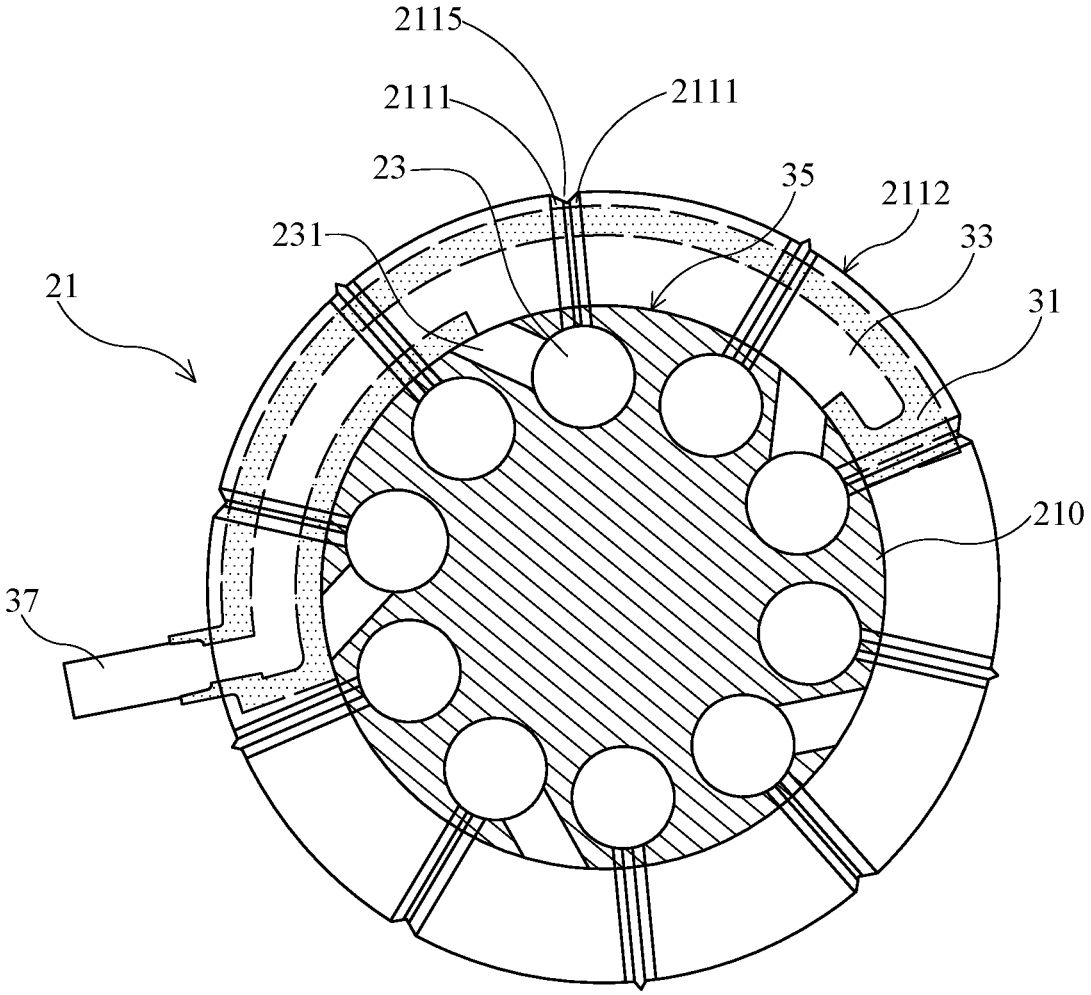
FIG. 7 is a perspective view of a protruding wheel of a fiber product folding and stacking system according to an embodiment of present invention.

In one embodiment of the present invention, as shown in FIG. 7, a plurality of grooves 2115 are disposed on the outer surface 2112 of the protruding wheel 211 of the folding wheel 20, and the suction channels 2111 are adjacent to the grooves 2115. For example, suction channels 2111 may be respectively disposed on both sides of each groove 2115. When the folding wheel 21 is rotating to the predefined position, the suction channel 2111 that is adjacent to portion of the grooves 2115 will communicate with the connecting opening 37 via the valve opening 35 and the valve channel 33 of the valve 30. Thus, the suction channels 2111 on both sides of portion of grooves 2113 of the protruding wheel 21 are caused to generate the negative pressure to adsorb the fiber product, and perform a folding operation of the fiber product.

Figure 8:
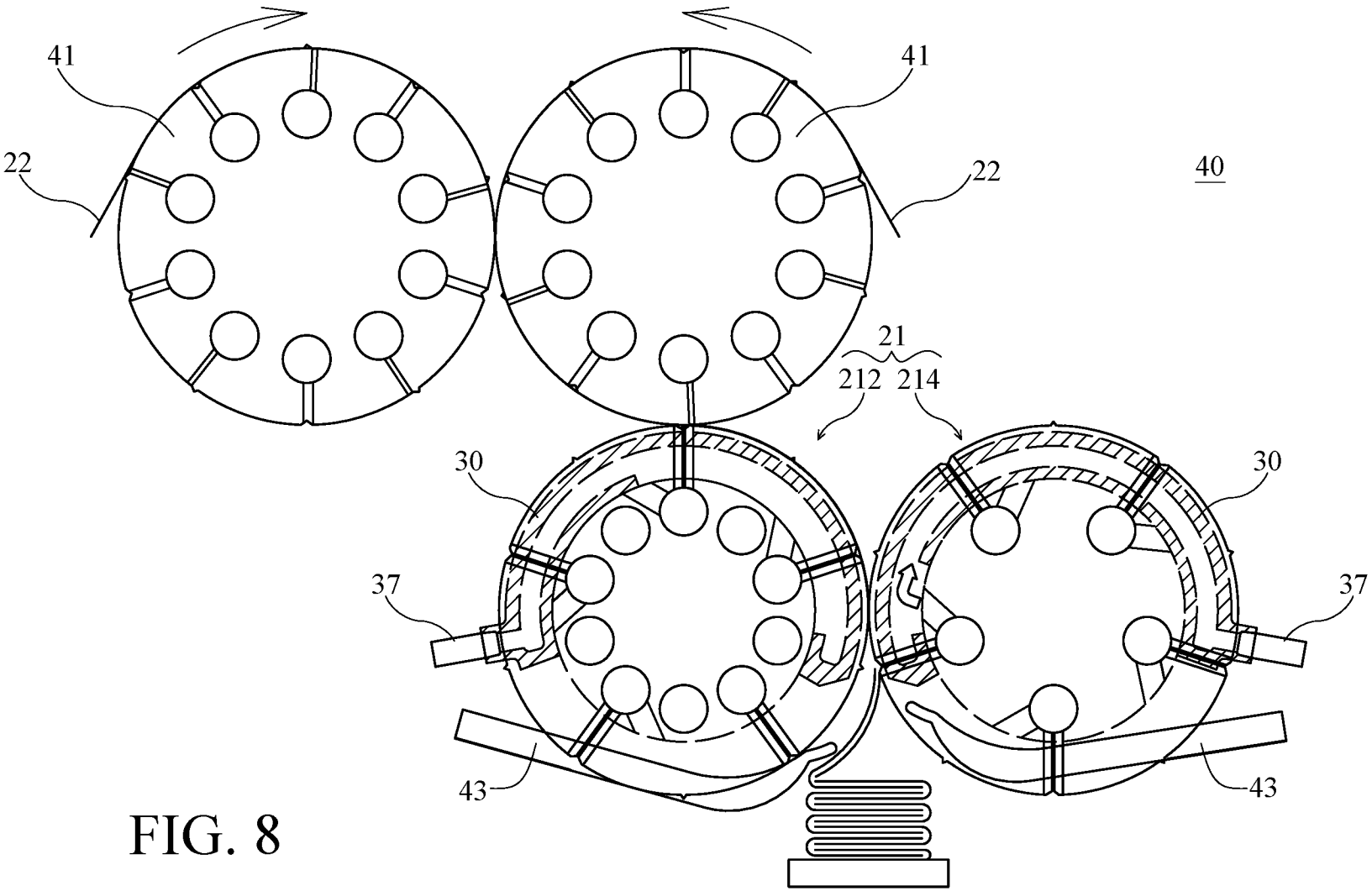
FIG. 8 is a cross-section view of a fiber product folding and stacking system according to an embodiment of the present invention.

FIG. 8 is a cross-section view of a fiber product folding and stacking system according to an embodiment of the present invention. As shown, the fiber product folding and stacking system 40 includes two cutter wheels 41, two folding wheels 20, and two folding finger 43, wherein two cutter wheels 41 are disposed adjacent to each other, and two folding wheels 20 are disposed adjacent to each other.

Two cutter wheels 41 are respectively rotating in clockwise and counter clockwise directions to cut the fiber product 22 that passes therebetween. The two folding wheels 20 are respectively rotating in a clockwise and counter clockwise direction to fold the fiber product 22 that passes therebetween. The folding wheels 20 are located downstream of the cutter wheels 41 for receiving the fiber product 22 from the cutter wheels 41. For example, one of the folding wheels 20 is adjacent to one of the cutter wheels 41, and receives the fiber product 22 form the adjacent cutter wheel 41.

Specifically, when the folding wheel 21 is rotating to a predefined position, the connecting opening 37 of the valve 30 will fluidly connect portion of the suction channels 2113 via the valve channel 33, the valve opening 35 and the passage 23. For example, the folding wheel 21 includes a first folding wheel 212 and a second folding wheel 214, wherein the first folding wheel 212 is adjacent to one of the cutter wheels 41. The suction channel 2111 of the first folding wheel 212 that approaches the cutter wheel 41 will be fluidly connected to the connecting opening 37 to form the negative pressure on the suction channel 2111 by the action of the air extractor 25. Thus, the first folding wheel 212 is able to receive the fiber product 22 from the cutter wheel 41, and adsorb the fiber product 22 on the surface of the first folding wheel 212.

The second folding wheel 214 is adjacent to the first folding wheel 212. In one embodiment of the invention, the suction channel 2111 on the second folding wheel 214 that approaches to the first folding wheel 212 will be fluid communication with the connecting open 37 to form the negative pressure on the suction channel 2111 by the action of the air extractor 25. Thus, the second folding wheel 214 can receive the fiber product 22 from the first folding wheel 212, and adsorb the fiber product 22 on the surface of the second folding wheel 214.

The folding fingers 43 are located downstream of the folding wheels 21. The suction channel 2111 on the second folding wheel 214 that moves to the vicinity of the folding fingers 43 does not be fluid communication with the connecting opening 37, so that the negative pressure on the suction channel 2111 will disappear. At this time, the fiber product 22 originally absorbed by the second folding wheel 214 leaves the second folding wheel 214, and falls by gravity. Then, the folding fingers 43 will press the falling fiber product 22 by swinging to fold the fiber product 22.

In another embodiment of the invention, the suction channel 2111 on the first folding wheel 213 that approaches to the second folding wheel 214 will be fluid communication with the connecting open 37 to form the negative pressure on the suction channel 2111 by the action of the air extractor 25 for adsorbing the fiber product 22 on the surface of the first folding wheel 212.

The suction channel 2111 on the first folding wheel 212 that moves to the vicinity of the folding fingers 43 does not be fluid communication with the connecting opening 37, so that the negative pressure on the suction channel 2111 will disappear. Thus, the fiber product 22 originally absorbed by the first folding wheel 212 leaves the first folding wheel 212, and falls by gravity. Then, the folding fingers 43 will press the falling fiber product 22 by swinging to fold the fiber product 22.

In one embodiment of the present invention, the valve 30 can be disposed within any of the recessing wheel 213 of the folding wheel 20.

The fiber product folding and stacking system 40 of the present invention supports the high speed operation of the folding wheel 20 to improve the working efficiency. Further, when the folding wheel 20 is operated at a high speed, the fiber product 22 is uniformly and stably adsorbed on the folding wheel 20 without causing deformation of the fiber product 22, thereby improving work quality.

The above disclosures are only the preferred embodiments of the present invention, and are not to be used to limit the scope of the present invention. All equivalent variations and modifications on the basis of shapes, structures, features and spirits described in claims of the present invention should be included in the claims of the present invention.

What is claimed is:

1. A fiber product folding and stacking system, comprising:

at least one folding wheel including a shaft, a plurality of protruding wheels, and a plurality of recessing wheels, said shaft being either one of a cylinder or a rod, each of said protruding wheels being disposed on said shaft along an axial direction thereof, and each of said recessing wheels being disposed between and adjacent to a corresponding pair of said protruding wheels;

a plurality of suction channels disposed within said protruding wheels, and fluidly connected to outer surfaces of respective said protruding wheels;

at least one valve disposed in any of said recessing wheels, wherein said at least one valve includes a connecting opening, a valve channel, and a valve opening, and said connecting opening is fluidly connected to said valve opening via said valve channel;

a plurality of passages disposed within said at least one folding wheel, and fluidly connected to said suction channels, wherein portions of said passages are fluidly connected to said valve opening of said at least one valve; and a plurality of connecting channels each fluidly connected to a corresponding one of said passages and an outer surface of a recessing wheel of said plurality of recessing wheels having said at least one valve, wherein said valve opening of the valve extends to cover at least portions of two said connecting channels on said outer surface of said recessing wheel, at least two connecting channels being thereby fluidly connected to said valve channel of said at least one valve through said valve opening.

2. The fiber product folding and stacking system of claim 1, wherein a position of said at least one valve is maintained during rotation of said at least one folding wheel, and said suction channels are sequentially connected with said valve channel of said at least one valve via a corresponding one of said passages to sequentially form a negative pressure on said suction channels of said at least one folding wheel.

3. The fiber product folding and stacking system of claim 1, wherein said suction channels of said protruding wheels are perpendicular to said passages of said at least one folding wheel.

4. The fiber product folding and stacking system of claim 1, wherein said outer surfaces of said protruding wheels include a plurality of protrusions, and said suction channels are disposed adjacent to said protrusions.

5. The fiber product folding and stacking system of claim 1, wherein said outer surfaces of said protruding wheels include a plurality of grooves, and said suction channels are disposed adjacent to said grooves.

6. The fiber product folding and stacking system of claim 1, wherein said at least one valve is either one of a semi-ring or a circular arc.

7. The fiber product folding and stacking system of claim 6, wherein said at least one valve includes an outer surface and an inner surface, and said inner surface of said at least one valve is connected with a corresponding outer surface of a corresponding recessing wheel of said plurality of recessing wheels.

8. The fiber product folding and stacking system of claim 6, further comprising two folding wheels adjacent to each other to fold a fiber product therebetween.

9. The fiber product folding and stacking system of claim 1, further comprising an air extractor connected to said connecting opening of said at least one valve for air suction within a corresponding one of said plurality of passages via said connecting opening, said valve channel of said at least one valve, and said valve opening of said at least one valve to form a negative pressure on said plurality of suction channels fluidly connected to said plurality of passages.

* * * * *